United States Patent [19]

Bilbrey et al.

[11] Patent Number: 4,475,666

[45] Date of Patent: Oct. 9, 1984

[54] AUTOMATED LIQUID DISPENSER CONTROL

[75] Inventors: Robert A. Bilbrey, Orinda; Bruce R. Koball, Emeryville; John S. H. Loram, Berkeley, all of Calif.

[73] Assignee: American Hospital Supply Corporation, Evanston, Ill.

[21] Appl. No.: 297,956

[22] Filed: Aug. 31, 1981

[51] Int. Cl.[3] ..... B67D 5/30

[52] U.S. Cl. ..... 222/14; 73/864.16; 222/41; 222/63; 604/152; 604/155

[58] Field of Search ..... 222/14–21, 222/23, 36, 37, 41, 63–65, 71, 309, 333; 73/864.12, 864.16, 864.17, 864.18; 422/100; 604/4, 7, 50, 65, 67, 152, 155; 250/231 SE

[56] References Cited

U.S. PATENT DOCUMENTS

| | | | |
|---|---|---|---|
| 3,173,575 | 3/1965 | Gugerli et al. | 222/309 |
| 3,701,345 | 10/1972 | Heilman et al. | 604/67 |
| 3,751,642 | 8/1973 | Todd et al. | 222/23 |
| 3,756,456 | 9/1973 | Georgi | 222/14 |
| 4,346,742 | 8/1982 | Chase et al. | 73/864.12 |
| 4,387,374 | 6/1983 | Weiner | 250/231 SE |

*Primary Examiner*—Joseph J. Rolla
*Assistant Examiner*—Laurence J. Miller
*Attorney, Agent, or Firm*—James F. Mitchell

[57] ABSTRACT

A servo controlled actuator for an automated liquid dispenser for dispensing reagents or diluting samples with reagent automatically in accord with a programmed local microprocessor or remote computer control. The dispenser has at least one reciprocable syringe, valving for it and a syringe actuator driven by a hybrid servo control. The actuator includes a bi-directional variable speed motor and an encoder developing a pulse train which in number is representative of the position of the syringe piston and in repetition rate is representative of piston velocity. A microprocessor controls the piston stroke from the pulse train by comparison to a memory-stored count and controls piston velocity in predetermined relation to the terminal end of piston travel.

5 Claims, 22 Drawing Figures

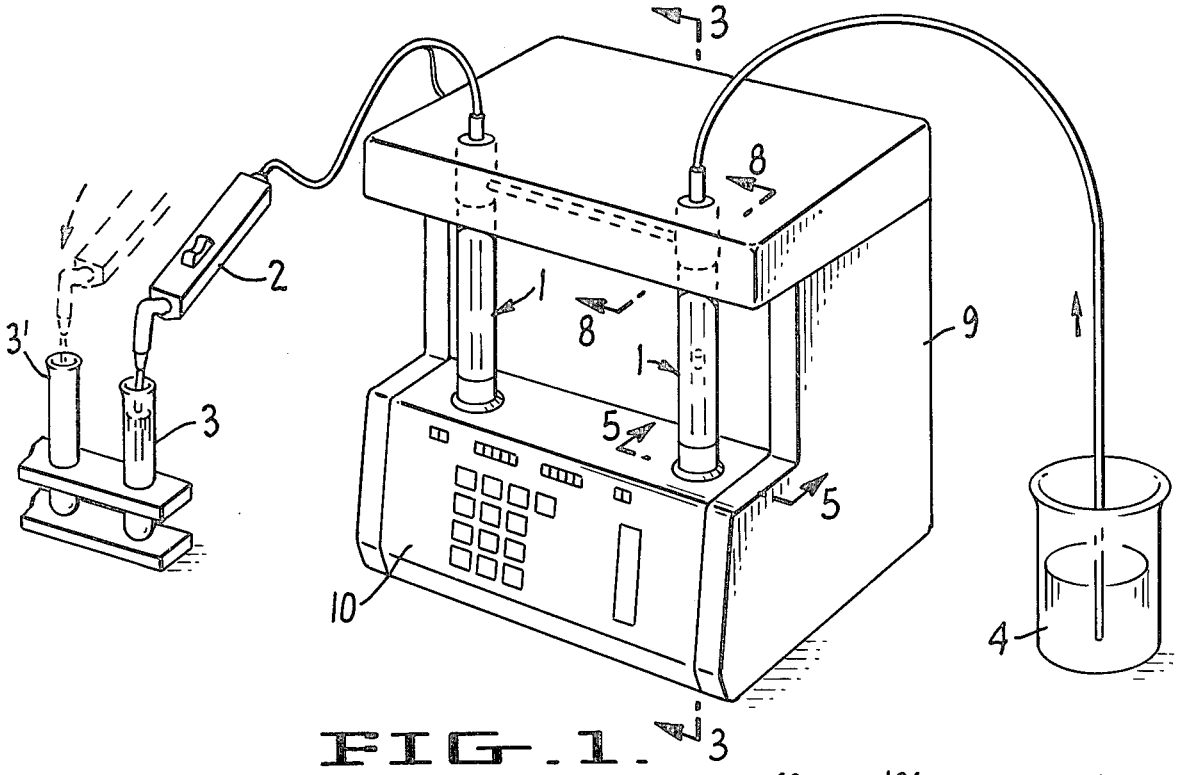
FIG. 1.
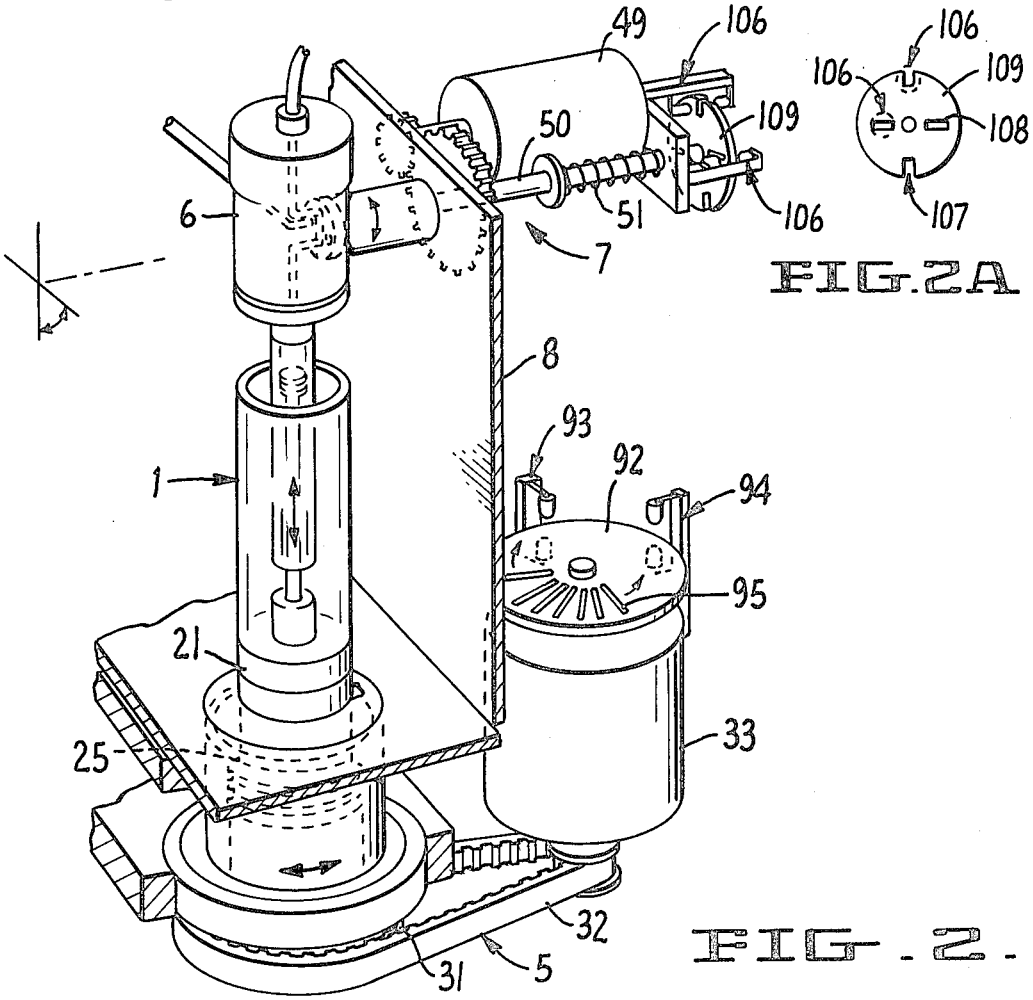
FIG. 2A
FIG. 2.

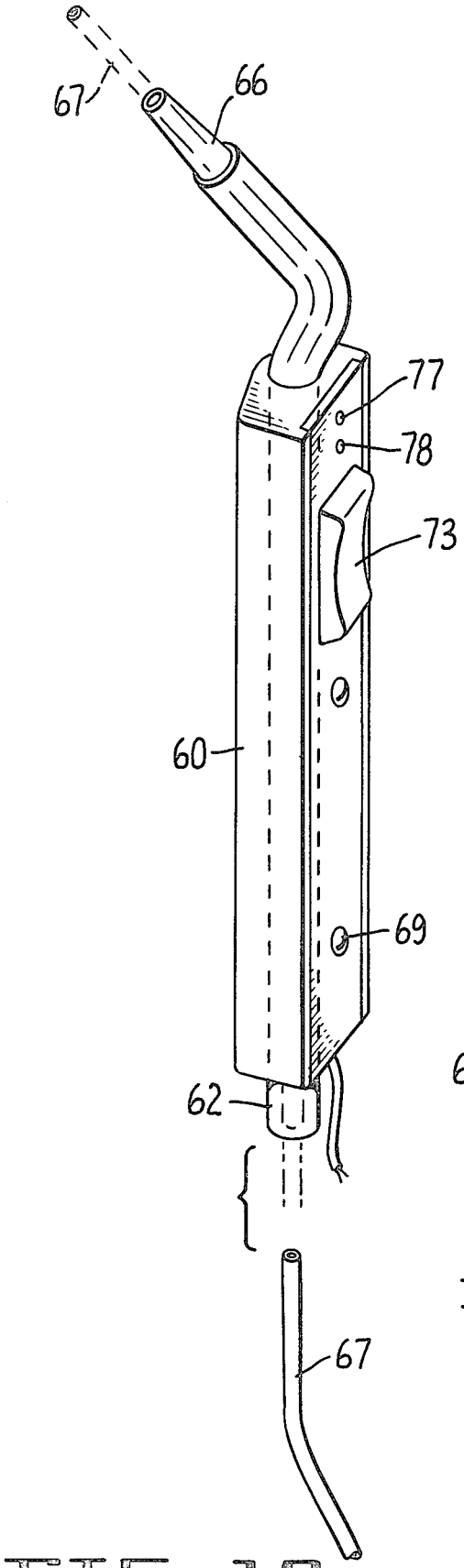
FIG. 18.
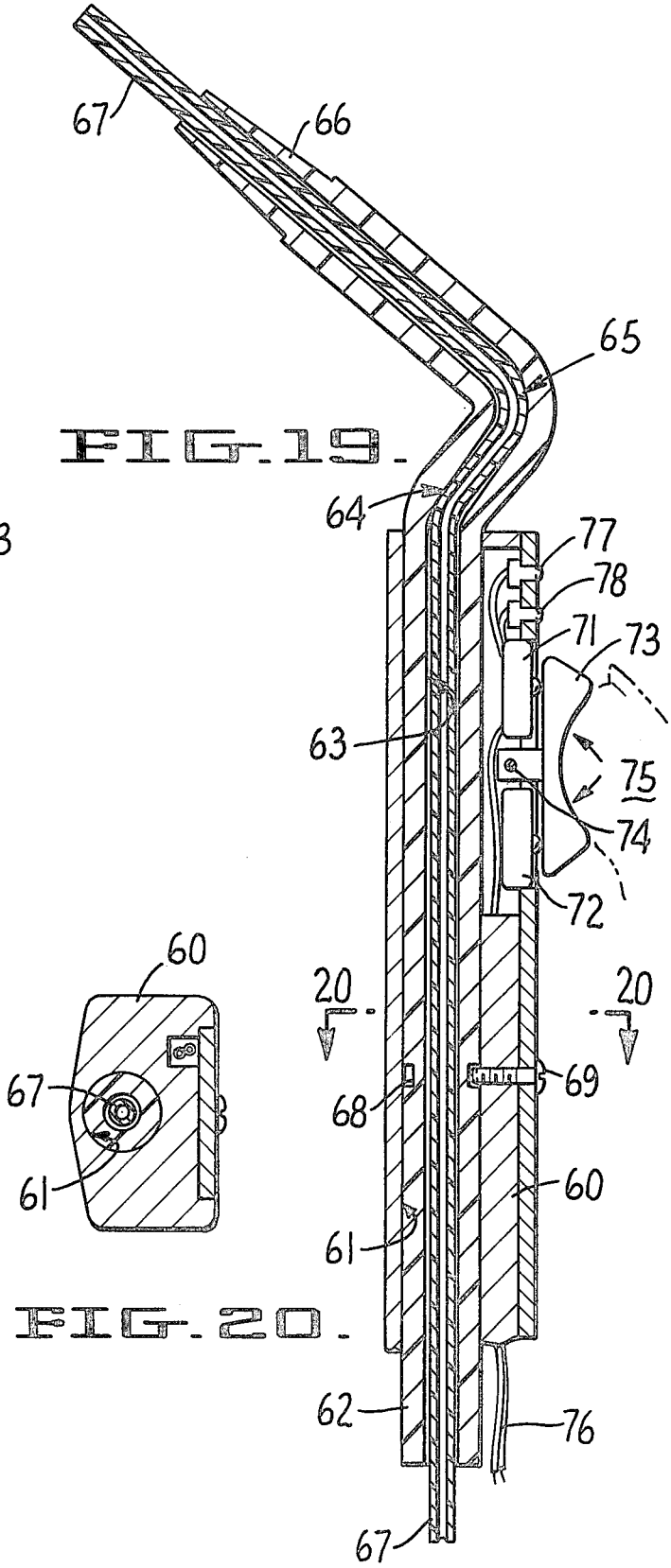
FIG. 19.
FIG. 20.

AUTOMATED LIQUID DISPENSER CONTROL

This invention relates generally to automated liquid dispensers and more particularly to electronic control for a bench-top laboratory instrument which employs one or more easily demountable precision metering syringes reciprocated in response to a programmed microprocessor or computer control for selectively dispensing reagent or diluting samples with reagent and other common normally manual laboratory procedures.

One object of the invention is to provide a precision laboratory instrument for automating many common normally manual liquid handling laboratory procedures with improved accuracy, precision, speed and reproducibility.

Another object of the invention is to provide a liquid dispensing apparatus capable of local microprocessor or remote computer control.

One other object is to provide precise servo control for each syringe which is responsive to its piston velocity, direction and position and compensates for mechanical backlash.

Still another object of the invention is a simple valve actuator and control for a plastic valve having planar seating faces which minimizes face wear.

Other objects and advantages of the invention will become apparent upon consideration of the following written description and the accompanying drawings wherein:

FIG. 1 is an overall perspective view of the liquid dispenser with dual syringes;

FIG. 2 is a partial perspective view illustrating a typical metering syringe and the actuator and valve means for it;

FIG. 2A is an elevational view of the position detector disc configuration shown in FIG. 2;

FIG. 18 is an enlarged perspective view of the probe illustrated in FIGS. 1 and 17;

FIG. 19 is a cross-sectional view of the probe showing its internal construction;

FIG. 20 is a cross-sectional view of the probe taken along line 20—20 of FIG. 19.

The instrument illustrated in FIG. 1 is designed for actuation of two precision metering syringes. The invention also is useful in the form of a single syringe shown in FIG. 17 or more than two syringes with appropriate valving and actuator changes which will be apparent from a consideration of the following description.

Figure 17:
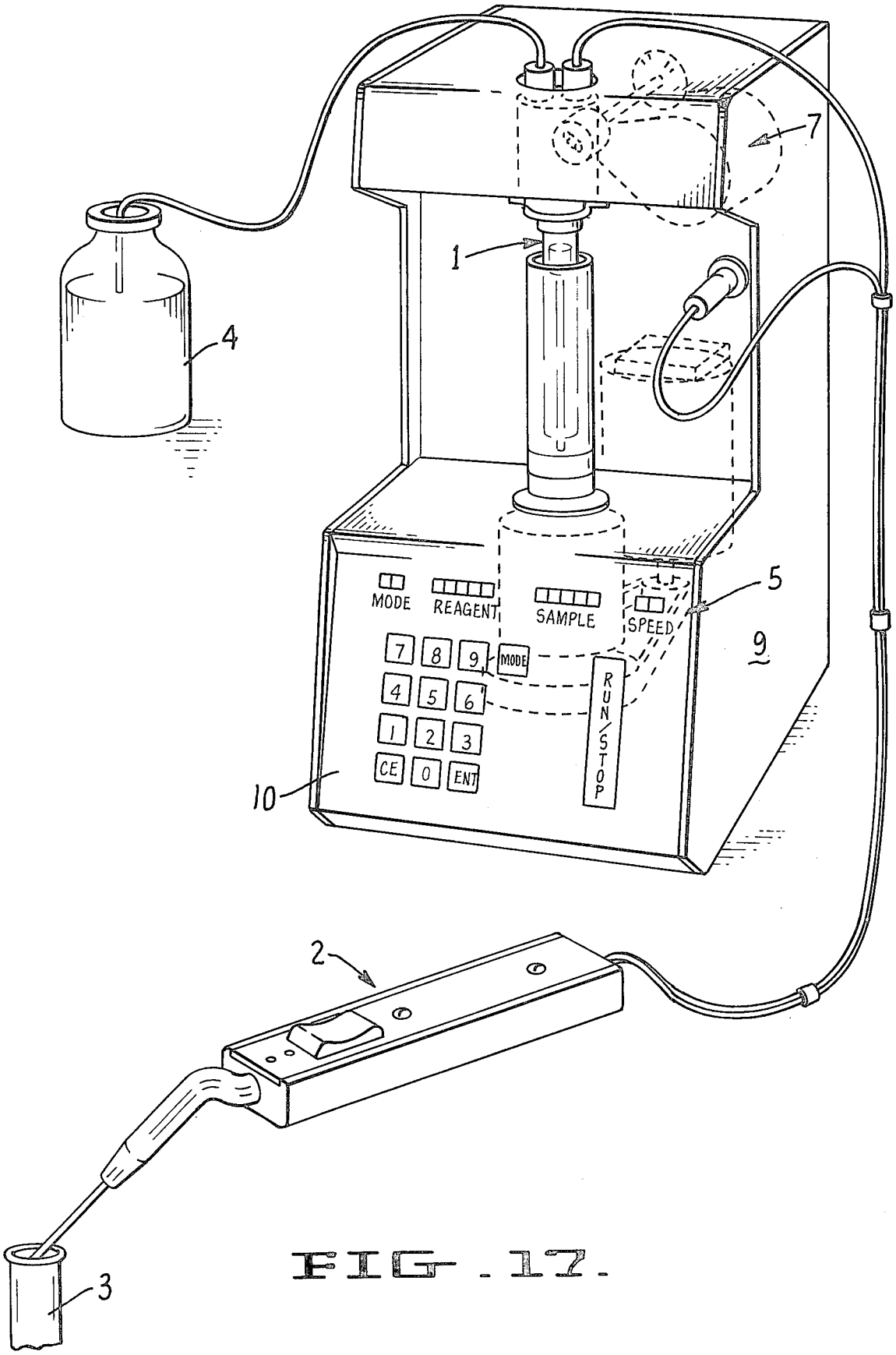
FIG. 17 is an overall perspective view of the liquid dispenser with a single syringe.

The illustrated instrument includes one or more precision metering syringes 1 arranged for drawing sample by means of probe 2 from a test tube 3, for example, or for dispensing sample or reagent-diluted sample into test tube 3', shown in hidden lines in FIGS. 1 and 17. The instrument is capable of withdrawing reagent from a reservoir, such as from beaker 4, and then using it to dilute a sample or otherwise to be dispensed from the probe 2.

Each metering syringe 1 mounts upon a syringe actuator, referred to generally as 5, in FIG. 2 at its rod end and is in fluid-tight communication with valve means 6 in FIG. 2. The syringe actuator 5, valve means 6 and its valve actuator, referred to generally as 7, mount upon a rigid frame 8. A housing 9 of chemical resistent material encloses the working components of the instrument apart from the metering syringes which are open for observation and ease of removal and replacement. A keyboard 10 for local microprocessor control mounts on the housing 9 on the front of the instrument adjacent to the metering syringes.

Figure 14:
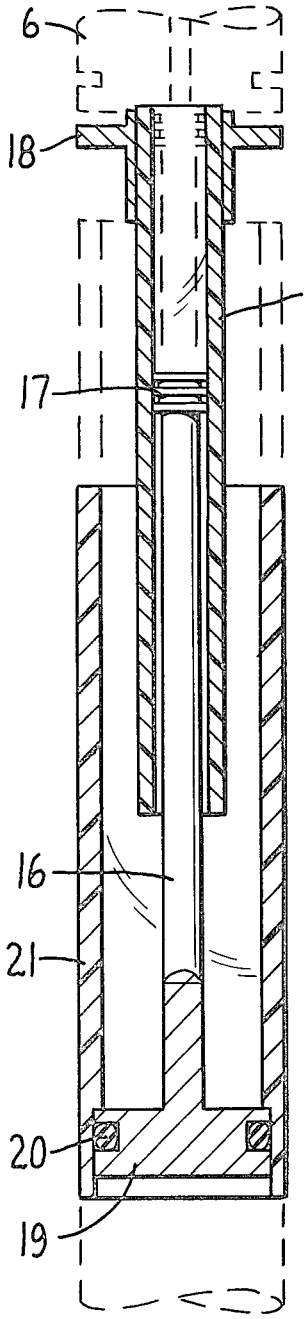
FIG. 14 is a vertical sectional view of a small bore syringe used in the instrument.
Figure 15:
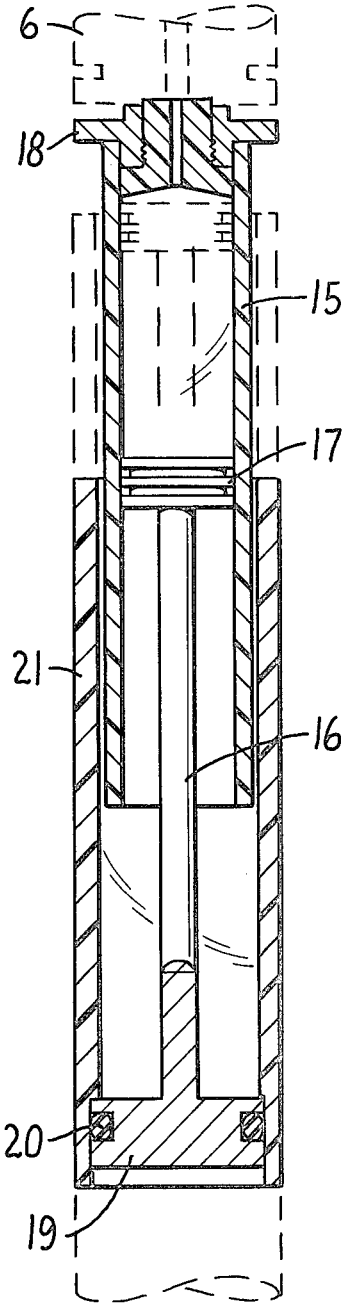
FIG. 15 is a vertical sectional view of a large bore syringe used in the instrument.
Figure 16:
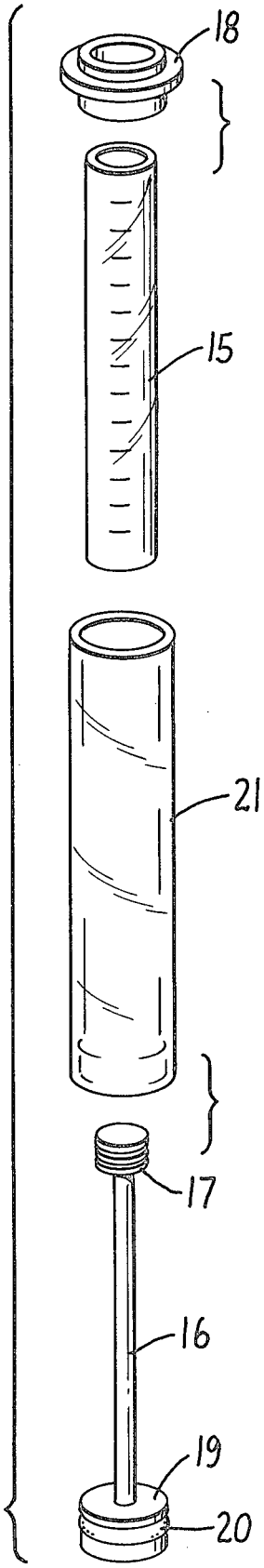
FIG. 16 is an exploded view of the metering syringe components.

Each metering syringe, as is more particularly shown in FIGS. 14–16, comprises a precision ground glass cylinder 15 and a piston 17 carried on a piston rod 16 reciprocable within the cylinder. A connecting flange and seat 18 seals upon the blind end of the cylinder. The seat fits within a recess in the valve means 6 that mounts upon the frame 8. The connecting flange 18 is clamped to the valve means 6 by clamp 22 and set-screw 23.

The end of the piston rod 16 remote from piston 17 carries a mounting flange 19 made from magnetic material. In the particular embodiment illustrated, the mounting flange 19 carries on its periphery an o-ring 20 with which to secure to the flange a centering sleeve 21. The centering sleeve, as is more particularly illustrated in FIG. 6, centers the mounting flange 19 upon the end of an externally threaded lead-screw nut 25 over which the sleeve fits. The nut 25 carries a permanent magnet 26 which holds the flange 19 of magnetic material firmly to the top of the lead-screw nut centered thereon by sleeve 21. The sleeve 21 sealed by o-ring 20 to mounting flange 19 also functions as an open reservoir to contain leaks or provide spill protection should a fragile glass syringe break, or fracture.

The external thread 27 on the lead-screw nut 25 threads upon corresponding threads 28 formed on the internal surface of lead-screw sleeve 29 which is rotably mounted in ball bearings 30 upon frame 8. The sleeve 29 is rotated by a toothed belt gear 31 and drive belt 32 by servo motor drive means 33 shown in FIG. 2.

Figure 5:
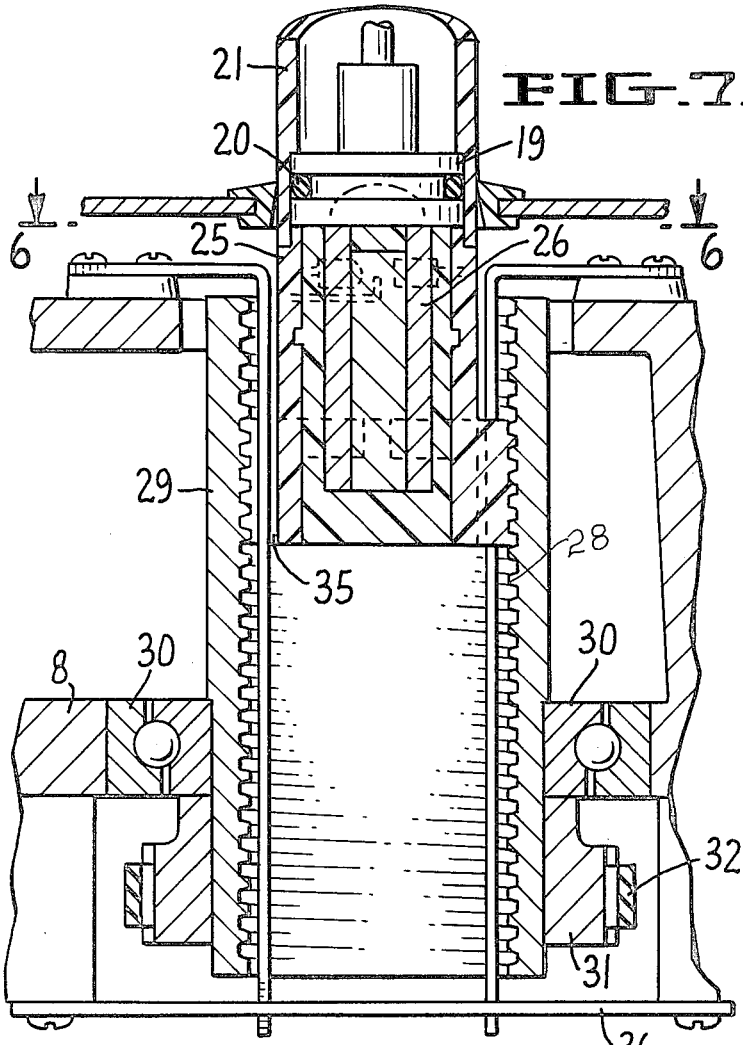
FIG. 5 is vertical sectional view of the lead-screw drive for one syringe actuator taken along line 5—5 of FIG. 1.
Figure 7:
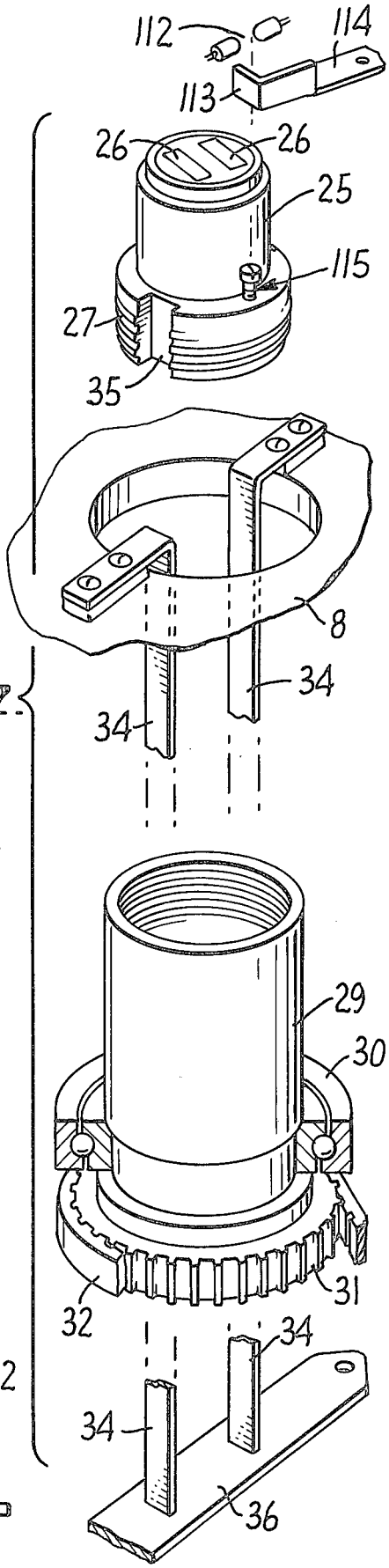
FIG. 7 is an exploded view of the internal lead-screw drive for each syringe actuator.
Figure 9:
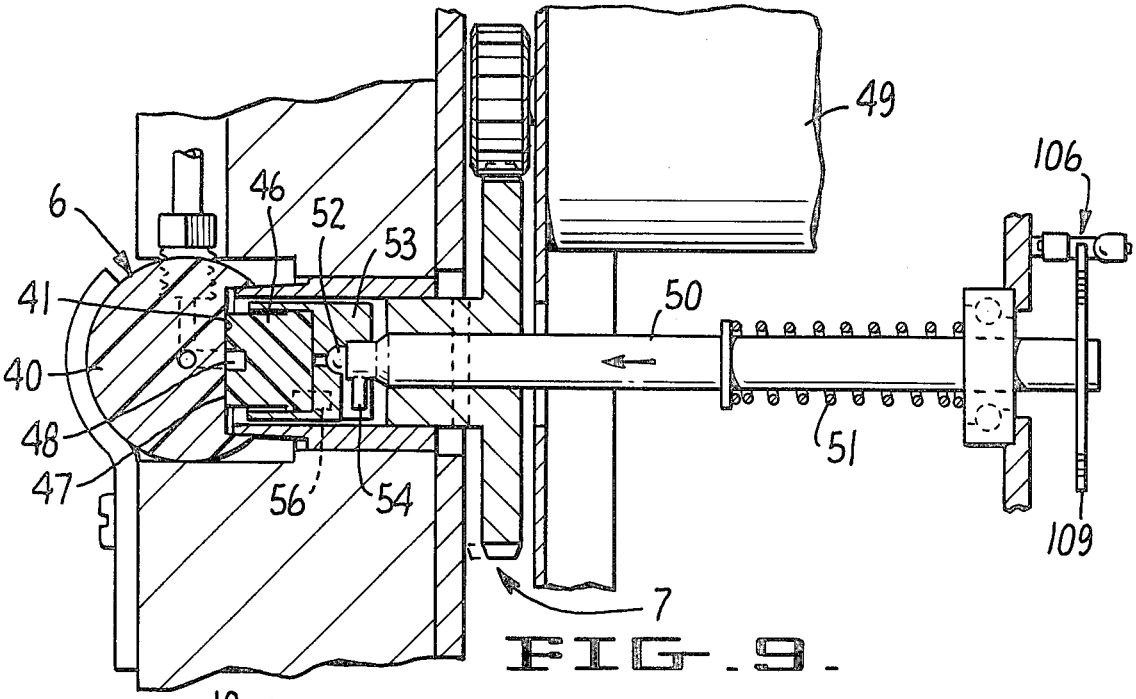
FIG. 9 is a plan view partly in section of the valve means and valve actuator taken along line 9—9 of FIG. 8.
Figure 8:
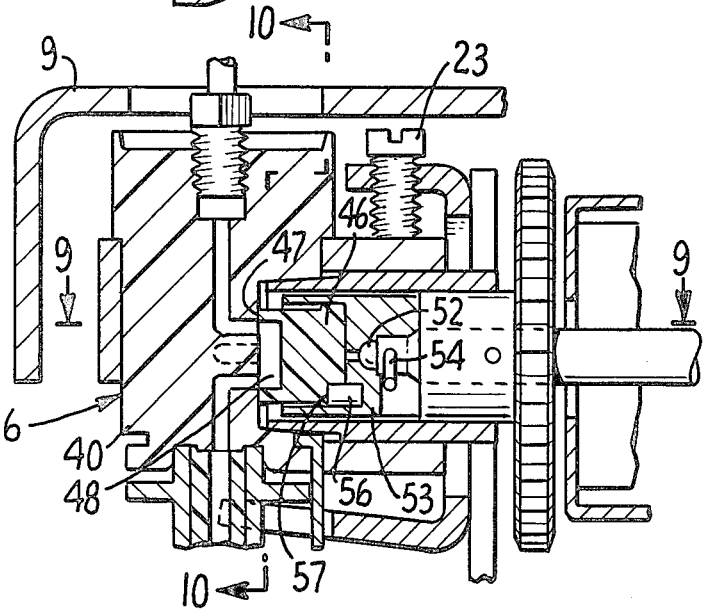
FIG. 8 is a vertical sectional view of the valve means for each syringe taken along line 8—8 of FIG. 1.

The lead-screw nut 25 is restrained from rotation relative to this sleeve 29 by the pair of brackets 34 mounted at one end upon the frame 8 as shown in FIG. 7 and passing through slots 35 formed in the lead-screw nut 25. The brackets are secured at the bottom ends also to the frame 8 by means of a slotted plate 36 which fits over the free end of each bracket and is screwed to the frame as is illustrated in FIG. 5.

Figure 10:
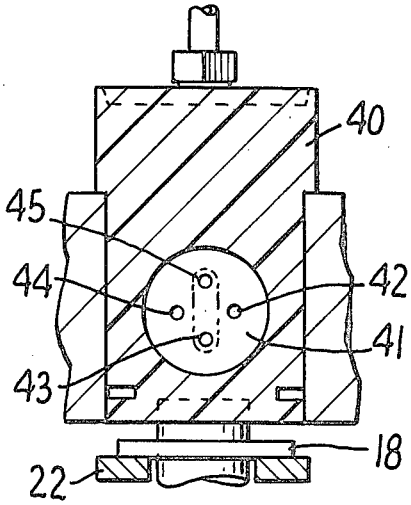
FIG. 10 is a vertical, partially sectional view of the valve means taken along line 10—10 of FIG. 8.
Figure 11:
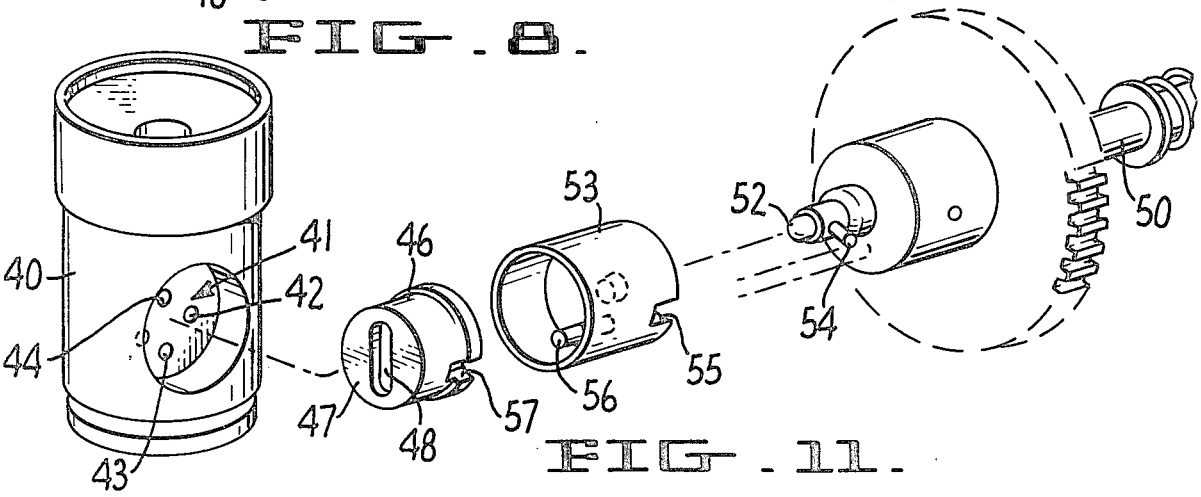
FIG. 11 is an exploded view of the valve means and valve actuator for each metering syringe.

The valve means 6 mounted in fluid communication with the blind end of each metering syringe is more particularly shown in FIGS. 8–11. Each includes a valve body 40 having a generally planar valve seat 41 bored with four ports 42, 43, 44 and 45 as illustrated in FIG. 10. The illustrated ports are in diametrically opposed pairs and each is equidistant from the rotational axis of a mating rotor 46. The spring-loaded rotor 46 has a replaceable seating face 47 having a fluid communication groove 48 on its valving face which communicates pairs of the ports 42,44 or 43,45 with one another in a programmed selection sequence by valve actuator means 7. The valve actuator may be a gearhead motor or the illustrated drive motor 49 geared to a drive shaft 50 that is biased by spring 51, ball 52 and sleeve 53 against the rotor 46 to hold the rotor in fluid-tight seating relationship with the valve seat 41. The pin 54 carried on drive shaft 50 mates with a recess 55 in the sleeve 53 and pin 56 on the sleeve mates with recess 57 in rotor 46 to enable the actuator means 7 to rotate the groove 48 into selected communication among the valve port pairs 42,44 or 43,45.

The hand held probe 2 may carry electrical switches for actuating the delivery and aspiration cycles by energizing the valve actuator 7. The probe also may include indicating means showing the instantaneous status of the sequential mode of operation. The probe handle clamps to chemically inert tubing communicating it with the valve means 6 for one or several of the metering syringes. The tubing is bundled with electric conductors connecting the probe switches, microprocessor and valve actuating means.

The particular hand-held probe 2 illustrated in FIGS. 1 and 17 is shown in more detail in FIGS. 18–20. It comprises a handle 60 formed of an elongated bar of tubular or rectangular cross-section material, such as plastic, having a longitudinal circular bore 61 in the embodiment shown. A tube holder 62 fits within the bore preferrably in an interference fit. The tube holder is generally tubular in shape with internal bore 63 and at the one end has a goose-neck configuration with a pair of reverse curves 64, 65. The tube holder 62 ends beyond the goose-neck in a nose portion 66.

Ther tube holder 62 carries within it Teflon flexible pipette tubing 67 frequently used in pipetting which communicates with the valve means 6. The tubing 67 trains through the internal bore 63 of holder 62. The reverse curves at 64 and 65 provide interference or frictional engagement of the tubing 67 against the interior walls of the bore 63 and hold the tubing 67 firmly within tube holder 62 during normal operation. On the other hand, tubing 67 can easily be replaced by pulling it out of the tube holder and inserting another piece of Teflon pipette tubing. The tube holder may be secured within handle 60 by an annular groove 68 around its periphery and a set screw 69 as shown in FIG. 20. This arrangement permits the operator to twist the tube holder within handle 60 to provide any 360° orientation for the nose portion 66 as the operator sees fit. The interference fit holds the selected orientation.

In the probe 2 illustrated in FIGS. 18–20 a pair of pressure switches 71, 72 mount in handle 60 adjacent to a push button 73 pivoted at 74 by the pressure of the thumb 75 of the operator into contact with one or the other of pressure switches 71,72. Appropriate electrical conductors 76 connect the probe switches 71,72 to the microprocessor and electronic valve acuating means mounted on the dispenser frame. The probe 2 also may include indicating means such as light emitting diodes 77,78 to indicate the instantaneous state of the dispener's sequential mode of operation. For example, LED 77 may light to indicate that the probe is ready to dispense sample or reagent and/or LED 78 may light to indicate the probe is ready to draw in sample or reagent.

Operation of the illustrated dispenser is automated by a local microprocessor control using keyboard 10. The dispenser operation also can be controlled by a programmed remote computer or a local preprogrammed ROM cartridge for specific dedicated service. The computers control the stroke and speed and sense the instantaneous position of each piston 17 in the metering syringes so that those parameters can be varied upon a command inputed through the keyboard 10 or remote computer interface.

Various modes of operation may be selected and preprogrammed into the illustrated microprocessor including the basic liquid transfers of drawing fluid into each syringe from the reagent reservoir, dispensing fluid from the syringe into the reagent reservoir, drawing fluid into the syringe from the sample probe tubing or dispensing fluid from the syringe into the sample probe tubing. Various modes of operation are obtainable including a dispense mode wherein a measured volume of liquid is drawn into a syringe from the reagent reservoir and then dispensed. In a pipette/dilute mode a measured volume of liquid is drawn from the reagent reservoir and then one or more separate samples are aspirated into the sample probe tubing with air gaps separating one sample from another and from the reagent. Then the total content of the syringe may be dispensed back out through the sample probe tubing. Various wash, purge and other modes can also be programmed into the microprocessor.

Figure 21:
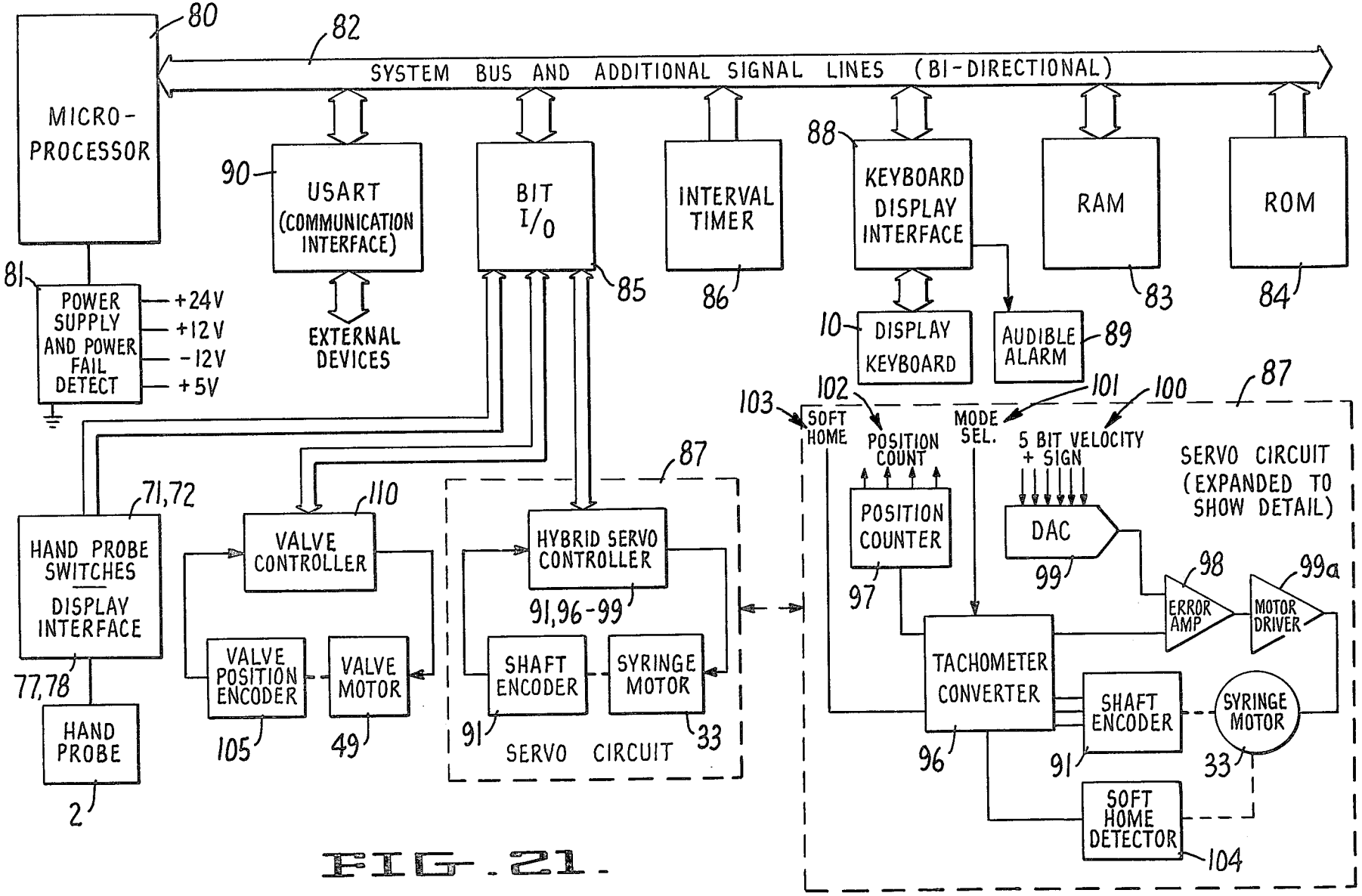
FIG. 21 is a schematic block diagram of the microprocessor control and other electronics for the illustrated dispenser.

The microprocessor and electronic control for the described dispenser is illustrated schematically in FIG. 21. It includes microprocessor 80 with power supply 81. A bi-directional system bus 82 interconnects the microprocessor 80 with a random access memory 83, a programmed memory 84, bit input-output circuitry 85 for the probe switches, valve actuator and syringe actuator and interconnects an internal timer 86. A hybrid servo control circuit 87 is provided for each syringe motor 33. Keyboard-display interface circuitry 88 connects the keyboard and display 10 to the microprocessor 80 and has audible alarm 89. The system bus 82 also may interconnect the microprocessor 80 with a universal synchronous/asynchronous receiver transmitter (USART) and interface circuit 90 for connection with other devices such as an external computer control of perhaps a local preprogrammed cartridge memory for dedicated service.

The foregoing components are generally available chips for various applications and in one embodiment of the system include:

| | |
|---|---|
| microprocessor (80) | Intel 8085 |
| RAM (83), bit I/o (85) | Intel 8156 |

-continued

| | |
|---|---|
| and timer (86) | |
| ROM (84) | Intel 2716 or 2732 |
| keyboard/display (88) | Intel 8279 |
| USART (90) | Intel 8251A with RS232C interface |

Figure 3:
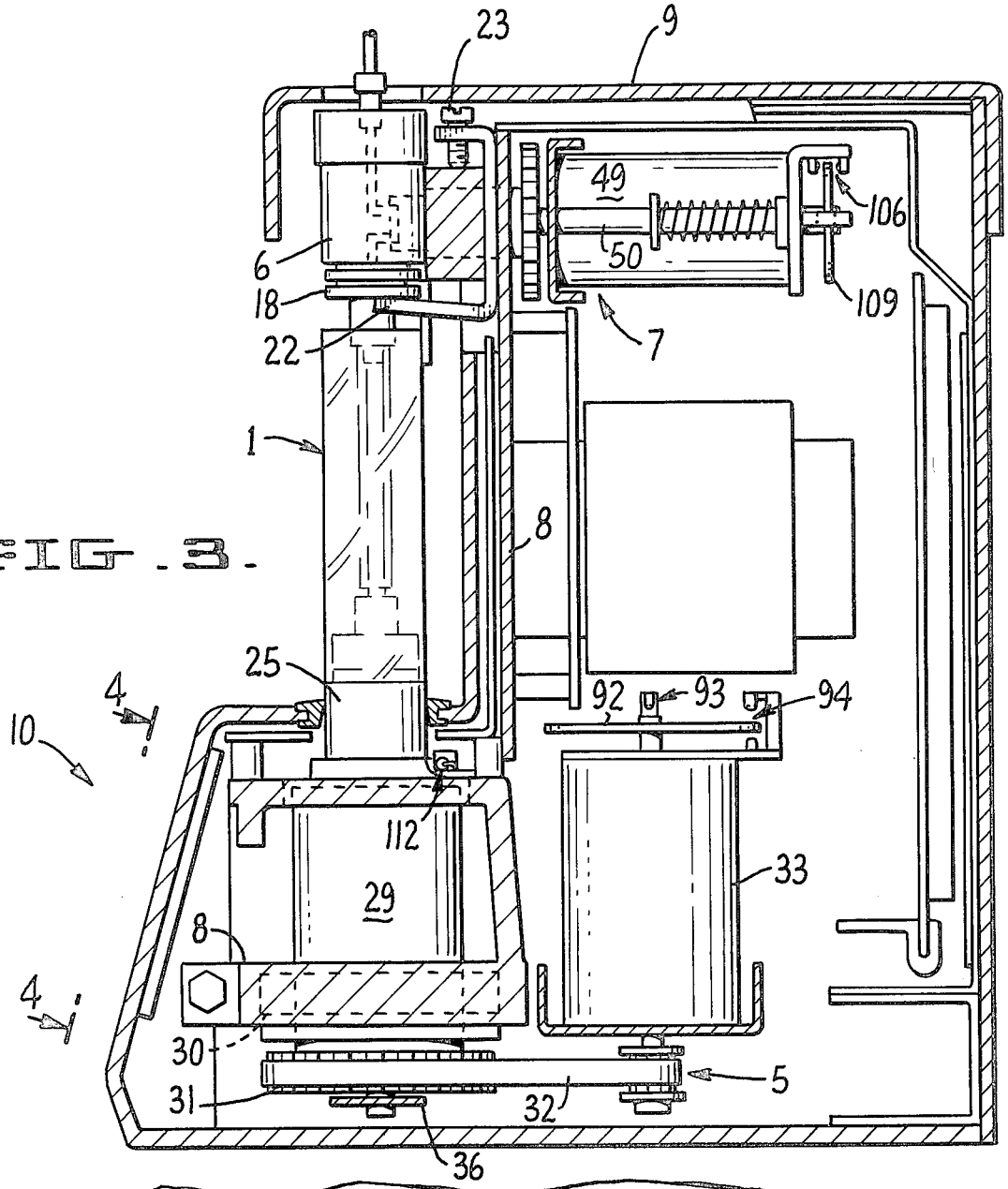
FIG. 3 is a vertical cross-sectional view of the instrument taken along line 3—3 of FIG. 1.

Each servo control circuit 87 is responsive to syringe piston velocity, direction and position and accurately positions, relative to one another, the lead-screw nut 25 and lead-screw sleeve 29 which drive each piston rod 16 as illustrated in FIG. 5. The hybrid servo system shown in FIG. 21 includes the bi-directional variable speed DC servo motor 33 shown in FIGS. 2, 3. A shaft encoder 91, which by reference to FIG. 2, includes slotted disc 92 on the motor shaft and a pair of optoelectric sensing means 93,94 arranged in phase quadrature that sense the presence of the one-hundred-fifty-five equally spaced slots 95 on disc 92. Each opto-electric sensing means can be a light coupled LED and a corresponding phototransistor, for example, to digitally encode syringe piston position, direction of movement and velocity as the rotating disc 92 interrupts the coupling. The encoder 91 supplies two trains of pulses in phase quadrature to tachometer converter 96 to control velocity and direction of motor rotation. The encoder 91 also supplies the pulses to position counter 97. It accumulates the pulse count the total of which is representative of the instantaneous piston location from a "home" position. The tachometer converter 96 and a velocity control DAC 99 each supply an analog output to error amplifier 98 which operates in velocity or position mode. Its output adjusts velocity and position by driving a pulse-width modulation motor driver 99*a* for the variable speed DC motor 33.

The microprocessor 80 controls the hybrid servo 87 with eight output lines and receives information from the servo with five input lines. Five of the microprocessor output lines at 100 comprise a five-bit velocity command to DAC 99 of the servo which converts this command to a command analog current. The other output line at 100 selects the sign of the velocity command to control polarity of the motor driver 99*a* and, thus, the direction of motor rotation. Another output line at 101 selects the velocity or position mode for servo operation. Another output line, not shown, acts as a chip enable for the servo motor driver 99*a*. Four of the input lines at 102 comprise a four-bit position word input to the microprocessor from the position counter 97. A fifth microprocessor input line 103 is the home position sensor input which indicates that the syringe piston 17 is at "zero" volume or its "home" position within cylinder 15.

The hybrid servo system can operate in two modes, i.e. a velocity mode or position mode. The servo starts out in velocity mode as the microprocessor outputs an increasingly larger five-bit velocity command word to the velocity digital-to-analog converter 99 along with a directional sign bit at 100. The time between successive velocity commands is variable to provide a variable acceleration characteristic in the converter output voltage. This parameter is keyed to various other system parameters such as currently programmed speed, current syringe size, probe tip size and fluid viscosity. The servo responds by accelerating syringe motor 33 to the commanded velocity and in the programmed direction.

While the motor 33 is in motion the position counter 97 accumulates counts and is periodically polled by the microprocessor 80. In this way the microprocessor keeps track of the instantaneous position of the piston 17, lead screw nut 25 and sleeve 29. As components approach their desired destination, the microprocessor causes the syringe motor 33 to decelerate by outputing successively smaller command words to DAC 99. The point at which each command outputs is determined by a variable lookup table in the software. Each entry in the table represents the number of position counts remaining in the current stroke and the position in the table represents the velocity DAC command appropriate for that number of counts to be sent to DAC 99. The microprocessor periodically compares the number of counts remaining with the table entry for the current velocity DAC command. If the table entry is less than the current number of counts remaining, the velocity DAC command is not changed. If the table entry is greater than or equal to the number of position counts remaining, the velocity DAC word is decremented by one and a comparison is made with the next table entry until one is found which is less than the number of counts. This process is then repeated until the piston terminal position is reached. This strategy controls piston velocity to optimize liquid delivery performance by minimizing undesirable effects such as liquid cavitation, frothing, splashing and denaturation.

When the piston and lead-screw elements reach their desired position the microprocessor outputs a zero velocity word and switches the servo to position mode. This stops the syringe motor and locks it in place with an electronic detenting action. Should the encoder 91 supply a pulse to tachometer converter 96 in this position mode, error amplifier 98 is directed to supply a countering output to hold the piston position.

Mechanical system backlash which can occur between the lead screw nut 25 and sleeve 29 or in the drive belt 32 or between syringe piston rod and Teflon syringe tip and thereby cause imprecision and inaccuracy, is taken out of the system by the microprocessor 80 which adds a small amount of piston travel to every downward displacement of the piston and returns up the same amount as the piston moves upward to the end of the piston motion or "home" position to which the piston is always returned. Thus, the servo control always approaches its final home destination moving in the "up" direction to subtract any backlash and thus prevent it from affecting system precision and accuracy.

Figure 6:
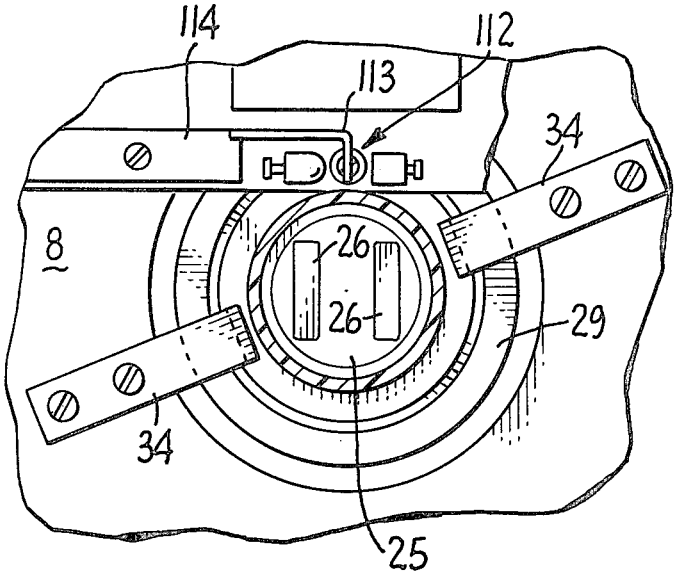
FIG. 6 is a top view of the lead-screw nut and its clamping arrangement taken along line 6—6 of FIG. 5.

The "soft home" detector 104 for the described dispenser includes another optically-coupled LED-phototransistor sensor 112 shown in FIGS. 6,7 which has its optical coupling interrupted by flag 113 mounted upon a flexure 114 secured to the frame 8 at the "soft home" position when abutment screw 115 on the lead-screw nut 25 moves the flag 113 upwardly to interrupt the optical coupling. The screw 115 permits adjustment of a precise "soft home" position short of the absolute or "hard" end of the piston stroke.

The valve motor 49 may be a permanent magnet synchronous motor drive in one direction with AC current from a secondary winding of the power transformer in power supply 81. It is controlled by the microprocessor 80 through opto-electric valve position encoder 105 and a triac. The valve position encoder 105 consists of a pair of sensors that are optically-coupled light emitting diodes and phototransistors 106 shown in FIGS. 2 and 3. They sense the presence of one of two differently positioned sets of slots 107, 108 on disc 109 that is attached to the drive saft 50 for valve rotor 46. One set of slots is on the disc periphery in one diametrically opposed pair, as at 107 shown in FIG. 2A, and represents the valve position with groove 48 communicating ports 43,45. The other set is cut inwardly from the disc edge in a diametrically opposed pair 108 to represent the port 42,44 position of the groove. The coupled light between the paired LED and phototransistor sensors 106 detects the valve position, with groove 48 communicating one or the other pairs of ports 43,45 or 42,44. The position information is fed to the valve controller 110 that interfaces with microprocessor 80. To switch the position of the valve groove 48, the microprocessor 80 turns on valve motor 49, which rotates the valve rotor 46 in one direction, and then polls the status of the valve position detector until the desired valve position is reached.

Figure 4:
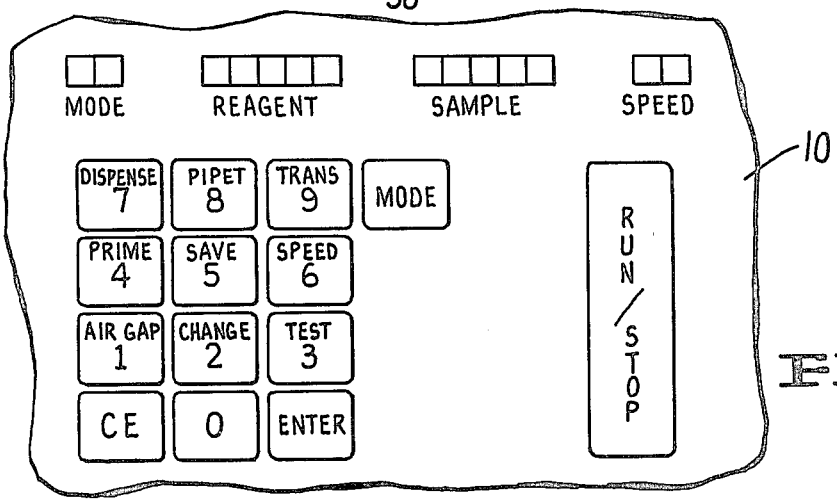
FIG. 4 is a plan view of one form of keyboard for the instrument taken along line 4—4 of FIG. 3.

In reference to the keyboard 10 of FIG. 4 the operator initially presses the mode key and then may select one of the modes on the other keys by pressing for example, the dispense, pipette, transfer, etc. key to select the desired mode. If the dispense mode has been selected, the letters DP appear in the "mode" display and the current value for the amount of reagent to be dispensed appears in the "reagent" display. The operator may press the "enter" button to accept the displayed regent quantity or enter a new value in RAM 83 by depressing appropriate numeric keys and then entering its value which also appears on the "reagent" display. Upon entering the new value, the indicator LED 78 for intake on the probe 2 is energized and the displayed amount of reagent then can be drawn into the syringe by pressing the push button 73 on the probe to actuate switch 72.

The microprocessor then enables the syringe actuator motor 33 in the down stroke direction. Its speed is accelerated in accord with the program stored in ROM 84 relative to instantaneous stroke position accumulated in position counter 97. The measured volume of reagent is drawn into the syringe from the reagent vessel 4. The microprocessor decelerates and then stops the motor 33 at the selected stroke volume. The dispense LED 77 lights and depression of push button 73 to actuate switch 71 dispenses reagent to pipette tubing 67 at probe 2 with the piston 17 returning to the soft home position. The microprocessor disables the motor drive when that position is detected by the soft home detector 104.

Figure 12:
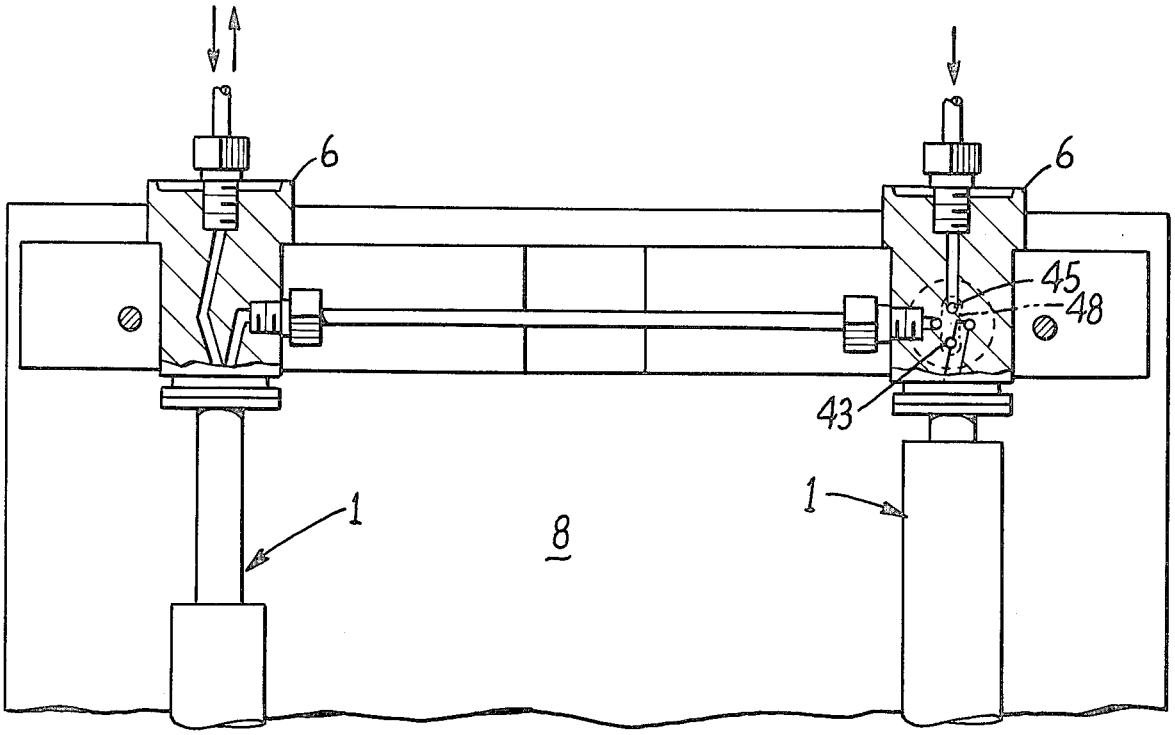
FIG. 12 illustrates the valving configuration for a dispenser with two syringes as shown in FIG. 1.
Figure 13:
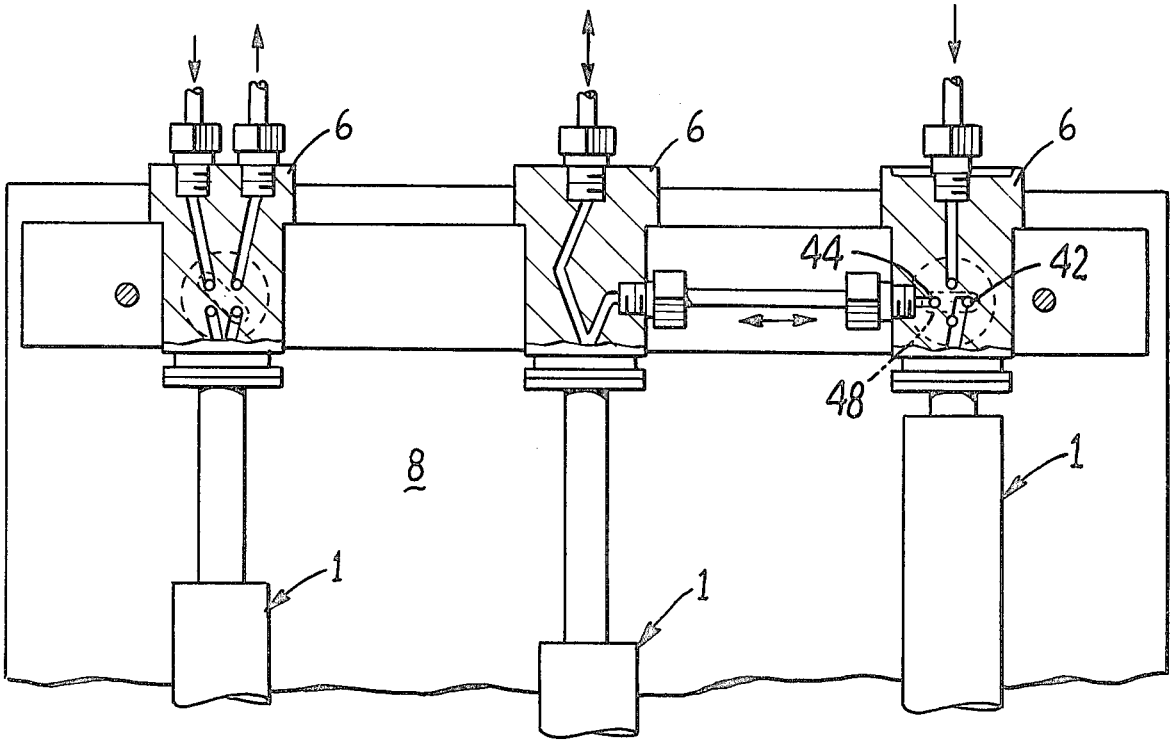
FIG. 13 illustrates the valving arrangement for a dispenser with three syringes for example.

Corresponding positioning of valve rotor 46 is accomplished by the microprocessor to switch the fluid communicating groove 48, for example, to the intake position shown for the right-hand syringe of FIG. 12 to connect the syringe port 43 with reagent intake port 45 to draw reagent into the syringe. At the bottom end of the stroke valve motor 49 switches the the groove 48 to communicate the syringe discharge port 42 to port 44 communicating with pipette tubing 67 as is shown in FIG. 13 for the righthand syringe.

The pipette and other modes can be similarly entered in the keyboard to draw in reagent as previously described. In pipette mode the operator selects a volume for each of the reagent and the desired number of samples by depressing the appropriate mode and digit keys and enters those values which appear in the reagent and sample displays along with a numeral to identify each particular sample. The microprocessor enables the motor drive 99a, the syringe draws in the entered amount of reagent and stops. The valve switches to dispense position and the piston moves down to draw an air gap into the end of tubing 67 from atmosphere to separate reagent from the first sample and the valve returns to intake position. The operator then places the probe in the sample reservoir, depresses the button 72,73 to draw sample into the probe. The operator repeats the sample take up for others that may be entered on the keyboard each time with an air gap between them. The operator then places the probe in position to dispense the entire contents of the pipette tubing and depresses the dispense button 71 to do so as described above.

Various modifications of the described dispenser microprocessor and control electronics will become apparent to those skilled in the art within the scope of the invention that is defined in the following claims.

We claim:

1. In an automated liquid dispenser having at least one metering syringe with a precision bored cylinder and a piston reciprocable within the cylinder, valve means for selectively connecting the syringe cylinder to one or more of a set of intake and delivery valve ports, a syringe actuator having a threaded lead-screw and a lead-screw nut for reciprocating the piston within the syringe cylinder, improved servo controlled drive means for rotating the lead-screw and lead-screw nut relative to one another comprising a bi-directional variable speed motor rotating one or the other of the lead-screw and nut;

an encoder developing from the motor rotation a train of pulses each representative of an increment of piston travel with their repetition rate representative of piston velocity;

a driver for said motor;

a position counter accumulating the pulses in said encoder pulse train;

a microprocessor for polling the position counter and comparing its accumulated count to a predetermined memory-stored count representative of lengths of piston stroke, and for disabling the motor driver when the accumulated count in the position counter reaches the memory-stored count corresponding to a preselected stroke length;

an error amplifier for supplying a variable velocity control signal to the driver for said motor;

a tachometer converting the pulse train from the encoder to an analog voltage proporational to velocity of piston travel that is supplied to the error amplifier;

a digital-to-analog converter also outputing an analog voltage to the error amplifier; and a microprocessor supplying a velocity command signal to the digital-to-analog converter in accord with memory-stored values relative to stroke end to cause an increase in converter output voltage during a preselected acceleration portion and a decrease in converter output voltage during a preselected deceleration portion of the piston stroke.

2. The automated liquid dispenser of claim 1 wherein the microprocessor periodically polls the position counter to ascertain the instantaneous position of the piston in its stroke, compares that count with the number of counts remaining in a preselected length of stroke for the piston and then outputs a velocity control command to the digital-to-analog converter corresponding to that position.

3. The automated liquid dispenser of claim 1 wherein a soft home detector senses piston arrival at a home position near one end of the piston stroke and causes the microprocessor to disable the motor driver upon the piston arrival at the home position.

4. In an automated liquid dispenser having at least one metering syringe with a precision bored cylinder and a piston reciprocable within the cylinder, valve means for selectively connecting the syringe cylinder to one or more of a set of intake and delivery valve ports, improved servo controlled drive means for rotating the lead-screw and lead-screw nut relative to one another comprising a motor rotating one or the other of the lead-screw and nut;

an encoder developing from the motor rotation a train of pulses each representative of an increment of piston travel with their repetition rate representative of piston velocity;

a driver for said motor;

a position counter accumulating the pulses in said encoder pulse train;

a microprocessor for polling the position counter and comparing its accumulated count to a predetermined memory-stored count representative of lengths of piston stroke, and for disabling the motor driver when the accumulated count in the position counter reaches the memory-stored count corresponding to a preselected stroke length; and a valve position encoder that supplies a position signal to the microprocessor representative of the position of the intake and delivery valve ports whereby the microprocessor in coordination with reciprocation of the syringe piston switches the valve position in a memory-stored sequence.

5. In an automated liquid dispenser having at least one metering syringe with a precision bored cylinder and a piston reciprocable within the cylinder, valve means for selectively connecting the syringe cylinder to one or more of a set of intake and delivery valve ports, a syringe actuator having a threaded lead-screw and a lead-screw nut for reciprocating the piston within the syringe cylinder, improved servo controlled drive means for rotating the lead-screw and lead-screw nut relative to one another having a velocity mode and a position mode comprising a bi-directional variable speed motor rotating one or the other of the lead-screw and nut;

an encoder developing from the motor rotation a train of pulses each representative of an increment of piston travel with their repetition rate representative of piston velocity;

a driver for said motor;

a position counter accumulating the pulses in said encoder pulse train;

a microprocessor for polling the position counter and comparing its accumulated count to a predetermined memory-stored count representative of lengths of piston stroke, and for disabling the motor driver when the accumulated count in the position counter reaches the memory-stored count corresponding to a preselected stroke length;

an error amplifier in a velocity mode for supplying a variable velocity control signal to the driver for said motor;

a tachometer converter converting the pulse train from the encoder to an analog output proportional to velocity of piston travel that is supplied to the error amplifier;

a digital-to-analog converter also supplying an analog output to the error amplifier; and a microprocessor supplying a velocity command signal to the digital-to-analog converter in accord with memory-stored values relative to stroke end to cause an increase in converter output during a preselected acceleration portion and a decrease in converter output during a preselected deceleration portion of the piston stroke, wherein the microprocessor at the terminal end of each piston displacement switches the error amplifier to position mode to supply a corrective countering output to the motor driver upon receipt of any signal from the tachometer converter.

* * * * *